US006572259B2

(12) United States Patent
Burnett et al.

(10) Patent No.: US 6,572,259 B2
(45) Date of Patent: Jun. 3, 2003

(54) APPARATUS AND METHOD TO DISPENSE A SLURRY

(75) Inventors: Tom Burnett, Campobello, SC (US); Wade Burnett, Campobello, SC (US); Hugh Burnett, Campobello, SC (US); Norton E. Cater, Simpsonville, SC (US)

(73) Assignee: Burnett Lime Co., Inc., Campobello, SC (US)

( * ) Notice: Subject to any disclaimer, the term of this patent is extended or adjusted under 35 U.S.C. 154(b) by 0 days.

(21) Appl. No.: 09/839,992

(22) Filed: Apr. 20, 2001

(65) Prior Publication Data

US 2002/0154569 A1 Oct. 24, 2002

(51) Int. Cl.[7] ..... B01F 15/02
(52) U.S. Cl. ..... 366/191; 366/194; 251/5
(58) Field of Search ..... 366/191, 184, 366/194; 417/422, 478; 130/30; 251/5, 7

(56) References Cited

U.S. PATENT DOCUMENTS 2,216,374 A * 10/1940 Martin ..... 138/30
2,712,831 A 7/1955 Day
2,735,642 A * 2/1956 Norman ..... 138/30
3,048,121 A * 8/1962 Sheesley ..... 417/478
3,063,470 A * 11/1962 Forster ..... 138/30
3,095,120 A 6/1963 Steiner et al.
3,353,560 A * 11/1967 McCulloch ..... 138/30
3,451,347 A * 6/1969 Chimura ..... 417/390
3,536,102 A * 10/1970 Allewitz ..... 138/30
3,605,815 A * 9/1971 Forell ..... 138/30
3,766,992 A 10/1973 Tiraspolskv et al.
3,800,984 A * 4/1974 Phelan
3,874,417 A 4/1975 Clay
3,951,572 A * 4/1976 Ray et al. ..... 417/478
4,135,550 A * 1/1979 Andersson ..... 251/5
4,452,572 A * 6/1984 Evrard ..... 417/478
4,632,976 A 12/1986 Asanuma et al.
4,784,295 A 11/1988 Holmstrand
4,811,758 A * 3/1989 Piper ..... 251/5
4,979,441 A 12/1990 Welch et al.
5,277,491 A * 1/1994 Burnett et al. ..... 366/194
5,931,648 A * 8/1999 Del Canizo ..... 417/480
5,957,759 A 9/1999 Cardenas et al.
6,039,078 A * 3/2000 Tamari ..... 138/30

* cited by examiner

*Primary Examiner*—Tony G. Soohoo
(74) *Attorney, Agent, or Firm*—Dority & Manning, P.A.

(57) ABSTRACT

An apparatus and method is disclosed to automatically maintain a desired back pressure on a slurry to facilitate the proper operation of pumping equipment and to eliminate or diminish scaling or other buildup in piping and related equipment.

25 Claims, 5 Drawing Sheets

APPARATUS AND METHOD TO DISPENSE A SLURRY

FIELD OF THE INVENTION

The present invention provides an apparatus and method for dispensing a slurry and facilitates the prevention of scaling or sedimentation in feed lines. While specific problems encountered in the dispensing of a lime slurry are discussed, the invention should be understood to apply to the dispensing of slurries generally.

BACKGROUND OF THE INVENTION

Slurries are used industrially for a variety of applications. By way of example, the physical properties of slurries may be utilized for polishing various industrial surfaces. Alternatively, chemical properties of a slurry may be important in applications such as waste treatment or water purification. In general terms, slurries are created by mixing solids, such as a powder, with liquids. While solvation may occur, typically slurries include particles of a solid suspended or present throughout the liquid phase.

The presence of the solid particles typically associated with slurries creates numerous processing challenges, particularly with pumping and flow through piping. For example, solid particles from the slurry may be abrasive and prone to settling out of the liquid phase when not constantly agitated or maintained at certain minimal velocities in processing systems. Abrasiveness can cause excessive wear on the components of a particular process. The settling out of various particles can clog piping as well as various instruments and components of a piping system.

Because of the abrasive nature of a typical slurry, positive displacement pumps are frequently utilized for pumping operations. Compared to other type of pumps available, positive displacement pumps offer enhanced pump life when using abrasive slurries. An undesirable consequence, however, of utilizing positive displacement pumps for the delivery of slurry is frequently a pulsing output pressure and/or velocity. The fluctuating changes in pressure and velocity may frequently result in undesirable settling of solid particles. This problem may be exacerbated as the diameter of output piping is decreased or the length of travel between the positive displacement pump and delivery point is increased. Furthermore, a back pressure generally must be maintained against a positive displacement pump to ensure its proper operation. Otherwise, slurry may be undesirably siphoned through the pump or clogging of the pump may occur.

Lime is a substance having a variety of useful applications. For example, as set forth in U.S. Pat. No. 5,277,491, which is incorporated in its entirety herein by reference, lime may be used to treat drinking water and waste water. The addition of lime can increase the alkalinity of water that has an undesirably low pH. Frequently, slurries created with lime and water are used for the delivery and application of the lime. Such lime slurries offer material handling challenges in addition to those discussed above with regard to slurries generally.

For example, to maintain a back pressure against a positive displacement pump being used to meter a slurry, a fluid such as water may be introduced under pressure at or near the discharge of the pump. While water under pressure can maintain the desired back pressure against the pump, with lime slurries undesirable scaling or calcification may occur as the water reacts with the lime in the slurry from the pump. The amount and rate of scaling will vary depending upon the pH and content of the water and lime slurry being used. For some applications, periodic maintenance may be required to remove the scale from certain equipment such as the piping or tubing being used to delivery the slurry. In addition, due to the possibility of problems with scaling, calcification, or other build-up, it was previously believed that piping or tubing with diameters smaller than approximately ¾ inches could not be used without undue problems. Undesirable limitations on the lengths of piping or tubing to transport lime slurry were also observed in an effort to minimize the effect of the build-up.

SUMMARY OF THE INVENTION

In accordance with one form of the present invention, there is provided an apparatus or process for delivery of a slurry. In certain embodiments, the present invention allows for slurry delivery over greater distances and allows the use of piping or tubing having smaller diameters than was previously believed acceptable. By way of example only, with the present invention, piping and tubing diameters of approximately ⅜" have been successfully tested with lime slurries. In addition, feed lines over 800 feet long have been successfully tested for lime slurries with the present invention. The frequency of maintenance previously required to remove buildup in equipment has been substantially reduced or even eliminated.

In accordance with one exemplary embodiment of the invention, a tank is provided for receiving the slurry. The tank has an outlet for release of the slurry and an agitator associated with the tank for providing agitation to the slurry. A conduit is provided in fluid communication with outlet of the tank and is used for delivering slurry from the tank to a pump. The slurry is pumped from the tank to a flexible member that has an interior surface in contact with slurry passing through the flexible member. The flexible member also has an exterior surface. The flexible member is located in a housing and together the flexible member and housing form a chamber for the receipt of a gas. The chamber receives gas for applying a pressure upon the exterior surface of the flexible member. The pump may be a positive displacement pump. The conduit may be inclined upwardly from the outlet of the tank to help maintain agitation of the slurry in the conduit. More specifically, the conduit may be inclined at an angle of at least 30 degrees from horizontal. Rubber may be used as a material of construction for the flexible member.

In another exemplary embodiment of the present invention, a vessel is provided that contains a slurry. The vessel has an opening for the flow of the slurry from the vessel to a pump. The pump has an inlet and an outlet. Means are provided in fluid communication with the pump and are adapted for using a gas to apply a pressure against slurry flowing from the outlet of the is pump. A conduit may be connected to the opening of the vessel to connect the vessel to the inlet of the pump. The conduit may be inclined upwardly from the opening of the vessel. An agitator may be provided with the vessel for agitating the contents of the vessel.

In still another embodiment, a tank is provided for receipt of the slurry. The tank has an upper portion and a lower portion. A lower portion has an outlet which is connected to a pump by a conduit. The conduit has an initial portion that is inclined upwardly from the point where the conduit connects to the outlet of the tank. An expandable member is provided that is in fluid communication with the pump. The expandable member has an interior surface forming a channel through which slurry flows and also has an exterior surface. The expandable member is configured so as to provide a back pressure on slurry being delivered from the pump. The expandable member may be received into a housing so as to form a chamber between the housing and the expandable member. Gas may be held in the chamber and used to apply pressure to the exterior surface of the expandable member. Means may be provided for monitoring the pressure of the gas in the chamber, and the tank may be equipped with an agitator for agitating the contents of the tank. Such agitator may include one or more propellers. The conduit may have a portion that is inclined upwardly from the outlet of the tank at an angle of at least 30 degrees or more from the horizontal.

In another embodiment of the present invention, there is provided a process for delivering a slurry. The process includes applying slurry to a pump. The pump has an inlet and an outlet. Slurry is discharged from the outlet of the pump to a flexible element that expands or contracts so as to provide a back pressure against the slurry discharging from the outlet of the pump. Pressure may be applied to the exterior surface of the flexible element using a gas. The amount of expansion and contraction of the flexible element due to changes in the slurry being fed through the flexible element may be adjusted by adjusting the pressure of the gas. In certain embodiments, the pump may be a positive displacement pump. Rubber may be used as a material of construction for the flexible element. After feeding the slurry through the flexible element, the slurry may be further transported for treatment, use, or storage.

In still another embodiment of the present invention, there is provided a process for dispensing a slurry that includes agitating the slurry within a vessel having an outlet. The slurry is fed from the outlet of the vessel using a pump that has an inlet and a discharge. The slurry is then pumped to means for using a gas to apply pressure back against the discharge of the pump. The slurry is then delivered to a desired application.

In still another exemplary embodiment of the present invention, there is provided a process for dispensing a slurry from a vessel to a remote location where the slurry may be stored, treated, or applied. The process includes pumping the slurry from the vessel using a pump. The slurry is then fed through a flexible member that is located downstream from the pump and configured for applying pressure to the pumped slurry. The size of the flexible member is then automatically adjusted in order to maintain a back pressure on slurry discharging from the pump. The slurry from the flexible member is then supplied to the remote location. The slurry may be agitated while present in the vessel.

These and other embodiments, features, aspects and advantages of the present invention will become better understood with reference to the following description and appended claims. The accompanying drawings, which are incorporated in and constitute a part of this specification, illustrate embodiments, or portions thereof, of the invention and, together with the description, serve to explain the principles of the invention.

DETAILED DESCRIPTION OF THE INVENTION

Although preferred embodiments of the invention are described herein using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged both in whole or in part. Therefore, the spirit and scope of the appended claims should not be limited to the description of the preferred versions contained therein.

Figure 1:
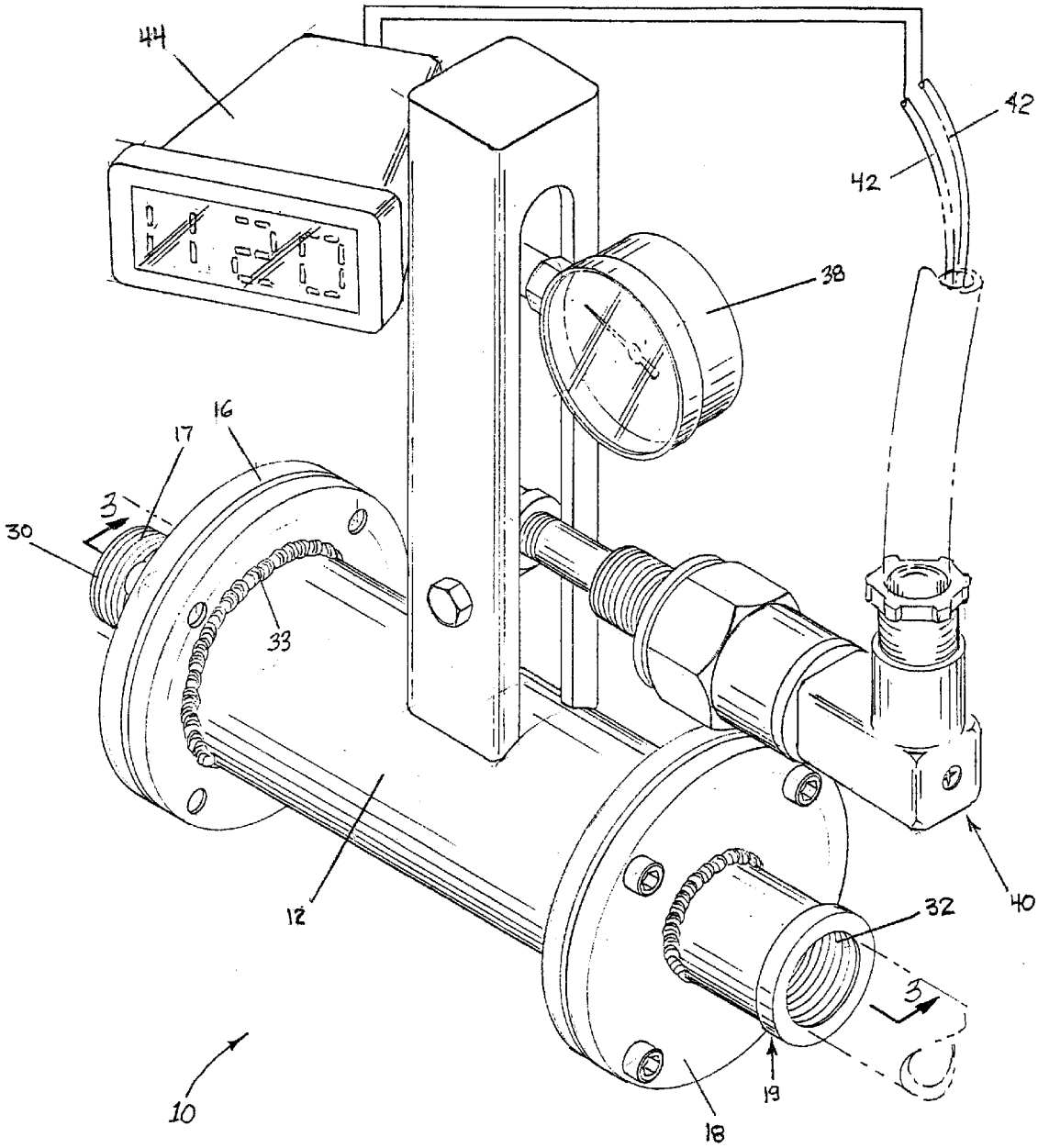
FIG. 1 is a diagrammatic representation of an embodiment of an apparatus forming a part of the present invention.
Figure 2:
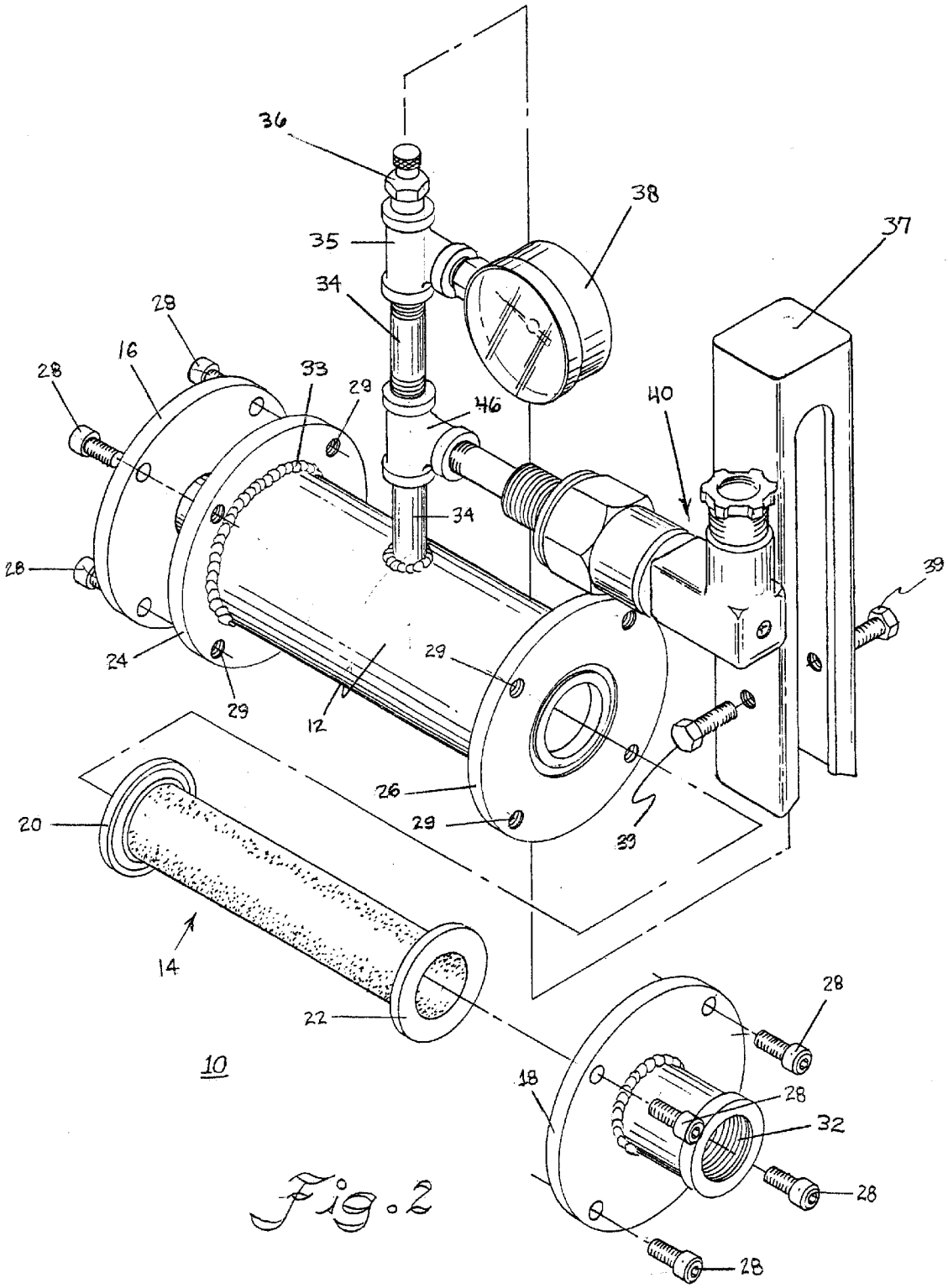
FIG. 2 is a partially exploded view of an embodiment of an apparatus forming a part of the present invention.

An exemplary embodiment of an apparatus 10 forming a part of the present invention for dispensing a slurry as shown in FIG. 1 and FIG. 2. A housing 12 is provided and contains flexible element or member 14. Inlet flange 16 and outlet flange 18 assist in securing flexible member 14 into a position inside housing 12. Flexible member 14 includes seals 20 and 22 that are secured between inlet flange 16 and housing flange 24 and outlet flange 18 and housing flange 26, respectively. Flexible member 14 is expandable and is constructed of any material or composite capable of expanding and contracting as will be described. By way of example, such materials may include rubber, various polymers, or combinations. One such flexible member 14 that may be used is constructed of Hypolon rubber and may be obtained from The Rubber Mill of Liberty, N.C. or Pulsafeeder Company of Rochester, N.Y. A plurality of flange bolts 28 are received into threaded holes 29 and are torqued so as to secure inlet flange 16 and outlet flange 18 as shown.

Inlet flange 16 is configured with an inlet nipple 17 having male threads 30. Accordingly, a dispensing apparatus 10 can be connected by inlet flange 16 to piping or other equipment supplying slurry to apparatus 10. In analogous fashion, outlet flange 18 is configured with outlet nipple 19 having female threads 32. Accordingly, apparatus 10 may be connected to downstream piping or other equipment to which slurry will be fed from apparatus 10. Housing flanges 24 and 26 are shown connected to housing 12 using welds 33, however, such flanges could be formed as a unitary part of housing 12. Using the teachings enclosed herein, one of ordinary skill in the art will understand that apparatus 10 can be connected within a system using components other than flanges 16 and 18 and such are depicted by way of example only.

For the exemplary embodiment depicted in FIGS. 1 and 2, a gas supply line 34 is shown connected to housing 12. Inlet valve 36 is used to admit or release gas from chamber 12. Alternatively, gas supply line 34 could be connected directly to a gas source such as a compressor, gas cylinder, or regulated gas supply. Apparatus 10 is equipped with pressure gauge 38 that is shown connected to gas supply line 34 using tee 35. Gauge 38 allows an operator to determine whether the desired gas pressure is present in housing 12 and also allows the observation of any pressure fluctuations during operation of apparatus 10. In addition, apparatus 10 is shown optionally equipped with an electronic sensor 40 connected by wires 42 to a local or remote display 44 as desired. Sensor 40 is shown connected to gas supply line 34 using tee 46. Any electronic sensor 40 suitable to the particular application and pressures in use may be utilized. One such sensor 40 that may be used is provided by Endress & Hauser, of Maulburg, Germany having a pressure range of 0 to 150 PSI. Accordingly, apparatus 10 may be equipped to display the pressure of gas in chamber 12 at a location remote from apparatus 10 as may be desirable in certain applications. In addition, apparatus 10 may be equipped with a controller that takes certain predetermined action based on the pressure in housing 12. For example, such controller could be used to start, stop, or otherwise control a pump feeding slurry to apparatus 10 based on the pressure being detected and changes thereof. While any gas suitable for materials of construction and environment of use may be used to supply pressure to housing 12, frequently air is used because equipment for providing the same is readily available or obtained. A cover 37 may be placed over valve 36 and gas supply line 34 and secured into position using a bolt 39. Cover 37 thereby helps prevent tampering with valve 36 once the pressure of gas in housing 12 has been set.

Figure 3:
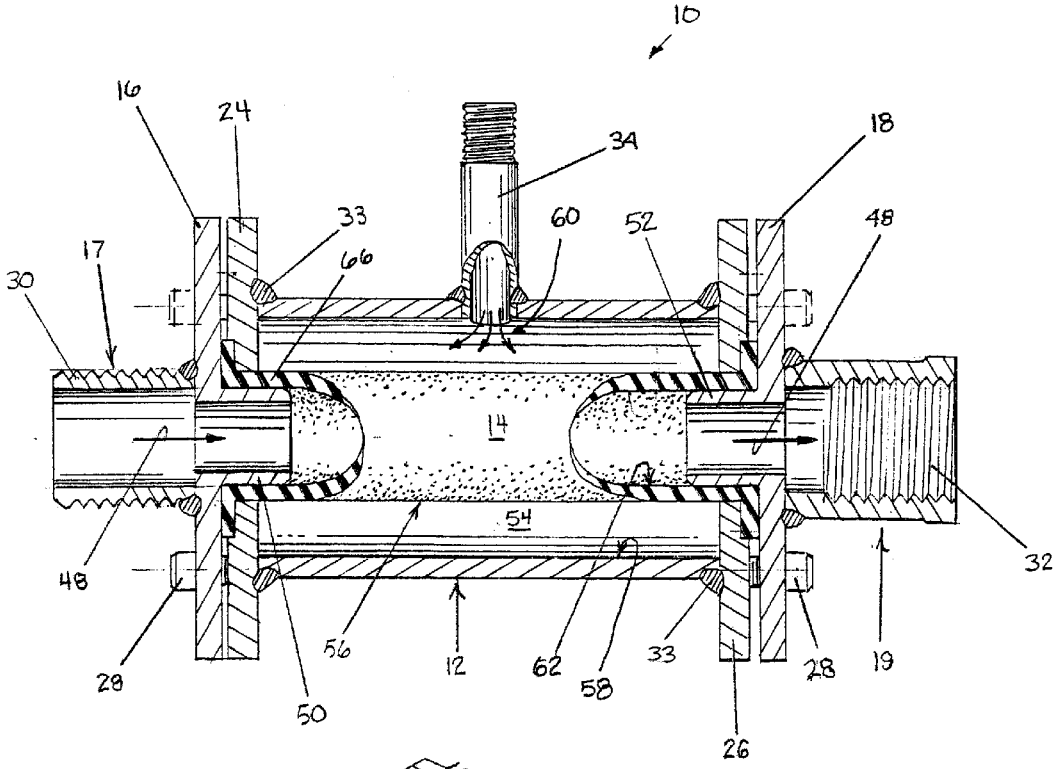
FIG. 3 is a partial sectional side view of an embodiment of an apparatus forming a part of the present invention.

Referring now to FIG. 3, flow arrows 48 indicate the flow of slurry into housing 12 during operation of apparatus 10. Slurry enters through inlet nipple 17 and flows through inlet flange guide 50. Slurry then flows through flexible member 14 and exits apparatus 10 by passing through outlet flange guide 52 and outlet nipple 19. The length of inlet nipple 17 and/or outlet nipple 19 can be varied to ensure proper placement and operation of flexible member 14. A chamber 54 is formed by the exterior surface 56 of flexible member 14 and the inside wall 58 of housing 12. As represented by arrows 60, chamber 54 is filled with a gas and set to a desired pressure using gauge 38 or remote display 44 and inlet valve 36. The gas then exerts a pressure on the exterior surface 56 of flexible member 14, which in turn exerts a pressure on the slurry in flexible member 14 through interior surface 62. By adjusting the pressure using valve 36, the pressure exerted on the slurry through interior surface 62 may be determined.

Figure 4:
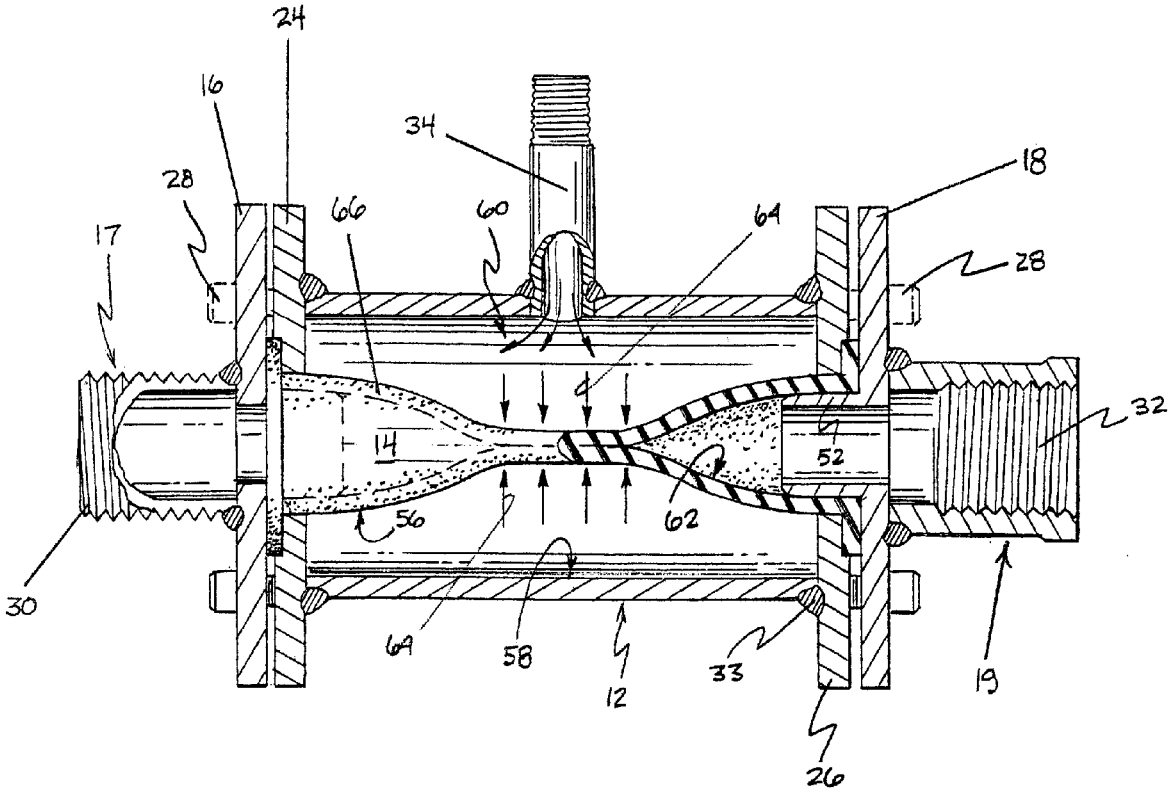
FIG. 4 is a partial sectional side view of an embodiment of an apparatus forming a part of the present invention.

As shown in the exemplary embodiment depicted in FIG. 4, flexible member 14 changes shape based on changes in the pressure or flow of slurry present therein. FIG. 4 shows flexible member 14 in a contracted state as would occur when the pressure of gas in chamber 54 exceeds the pressure of the slurry inside flexible member 14. By way of example, if slurry is being siphoned from apparatus 10 through outlet nipple 19, flexible member 14 will contract to maintain the upstream pressure of the slurry in contact with inlet nipple 17 as is depicted by arrows 64. As the flexible member 14 contracts, the amount of slurry within member 14 decreases. Alternatively, should the pressure of slurry entering apparatus 10 begin to increase, flexible member 14 can expand within housing 12 to dampen the pressure increase of the slurry. During the expansion, the amount of slurry in flexible member 14 increases.

For certain applications, flexible member 14 can be used to dampen fluctuations in the pressure of the slurry without using a gas to apply pressure to the exterior 56 of member 14 and such an embodiment is within the spirit and scope of certain claims of the present invention. In these applications, the flexibility or resiliency of the flexible member 14 acts without assistance of the gas pressure to dampen pressure or flow fluctuations in the slurry. To compensate for differences in pressures and flow from application to application, the flexibility or resiliency of member 14 is varied by changing the composition of the materials of construction and/or the physical dimensions of flexible member 14. By way of example only, for applications where higher pressures or flow are anticipated, a flexible member 14 having a thicker wall 66 and/or a material capable of absorbing larger pressure changes could be used. Accordingly, members 14 having varying degrees of flexibility or resiliency could be substituted into apparatus 10 until the desired performance was obtained based on the pressure of the slurry being fed to apparatus 10 and the fluctuations in such pressure.

Alternatively, by using flexible member 14 within a housing 12 as is shown in the exemplary embodiment depicted in FIG. 3 or FIG. 4, the responsiveness of apparatus 10 to changes in the pressure or flow of slurry can be adjusted by varying the pressure of the gas in chamber 54 using gas supply line 34 and inlet valve 36. For example, by increasing the pressure of the gas in chamber 54, more pressure is applied to the exterior surface 56 of flexible member 14. This increase in pressure is passed through wall 66 and is exerted on the slurry by interior surface 62. Accordingly, the increased gas pressure in chamber 54 allows apparatus 10 to maintain a greater pressure on slurry within flexible member 14. In addition, the increased gas pressure decreases the flexibility or expandability of the member 14 at a given pressure. Similarly, by decreasing the pressure in chamber 54, the pressure exerted on slurry within member 14 is also decreased and the flexibility or expandability of member 14 is increased at a given pressure. Therefore, the use of a gas or other compressible fluid to exert a pressure on the exterior of flexible member 14 allows apparatus 10 to be adjusted or tuned for proper operation in different applications or under varying operating conditions.

Figure 5:
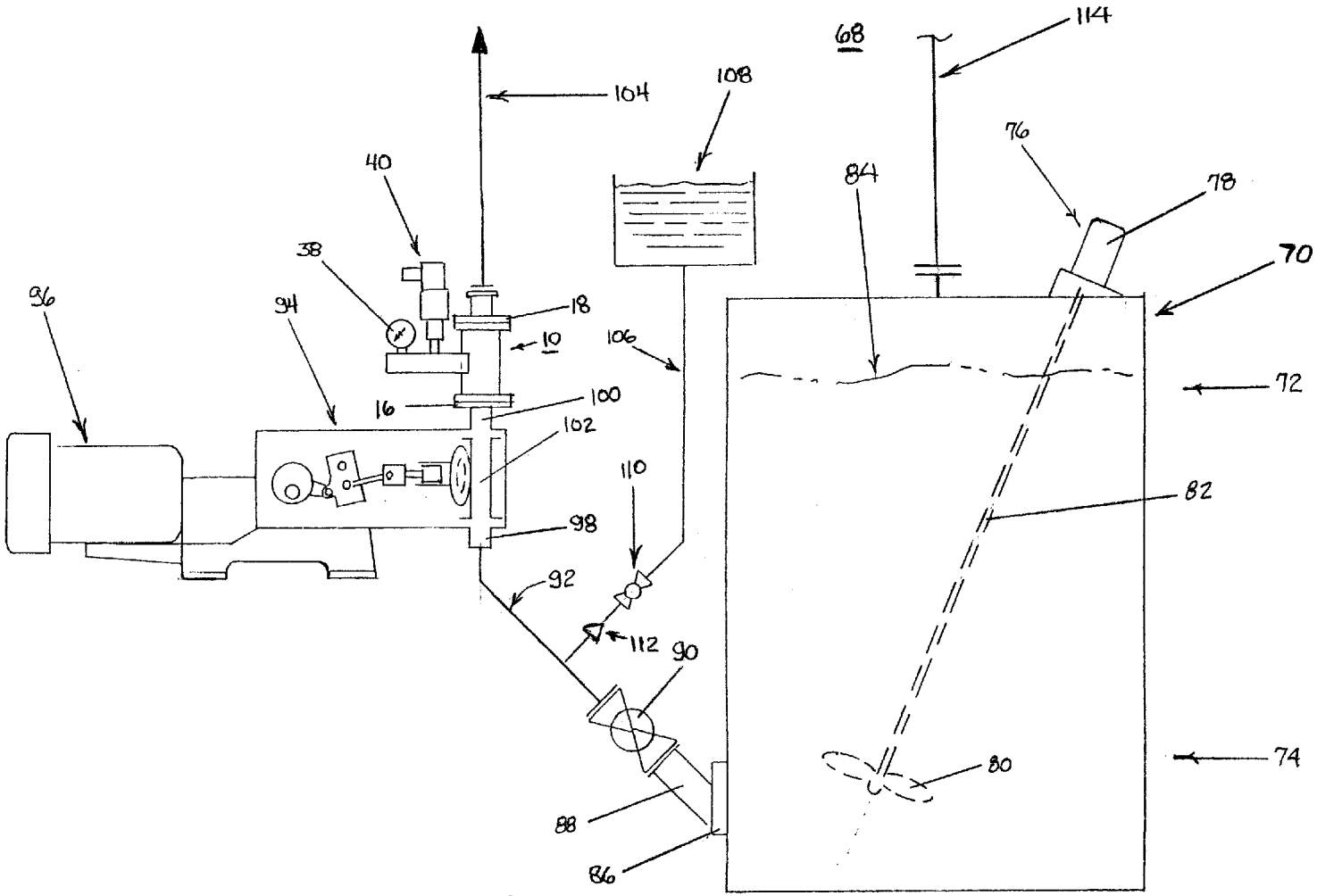
FIG. 5 is a partial schematic and diagrammatic representation of an embodiment of the present invention.

An exemplary embodiment of an apparatus 68 for dispensing a slurry is shown in FIG. 5. A vessel or tank 70 is provided having an upper portion 72 and a lower portion 74. Tank 70 is equipped with an agitator 76 that includes a motor 78 that drives propeller 80 using shaft 82 to agitate slurry in tank 70. Although not shown, tank 70 can be equipped with baffles, which may be preferable with certain types of slurry. The presence of slurry in tank 70 is depicted generally by surface line 84. Tank 70 includes an outlet 86 in the lower portion 74. Connected to outlet 86 is a tube or conduit 88. A portion of conduit 88 near the connection to outlet 86 is inclined upwardly in the exemplary embodiment depicted in FIG. 5. More specifically, if conduit 88 is maintained at an angle of at least 30 degrees with respect to horizontal, gravity will cause slurry particles in conduit 88 to fall back into tank 70 where agitation can occur. Conduit 88 is equipped with valve 90 to control the flow of slurry from tank 70.

Inlet line 92 provides a feed of slurry from tank 70 to positive displacement pump 94, which is driven by motor 96. Pump 94 has an inlet 98 for feeding in slurry, and a discharge or outlet 100 for pumping slurry out. An acceptable positive displacement pump that may be used with apparatus 68 is a Pulsa pump available from the Pulsafeeder Company of Rochester, N.Y. As described in U.S. Pat. No. 5,277,491, which is incorporated by reference, pump 94 has a straight flow through path 102 constructed from a tube preferably made of tetrafluoroethylene to further reduce flow restrictions and clogging. In the exemplary embodiment of FIG. 5, apparatus 10 is shown connected by inlet flange 16 to the outlet 100 of pump 94. The present invention does not require apparatus 10 to be directly connected to outlet 100 and, using the teachings disclosed herein, one of ordinary skill in the art will understand that apparatus 10 may be connected further downstream from pump 94. Through outlet flange 18, apparatus 10 is connected to a slurry feed line 104, which is then used to transport the slurry to further treatment, storage, or use.

For cleanout and maintenance, a fluid supply line 106 is shown connected to inlet line 92. Line 106 connects a fluid supply 108 to line 92. Valve 110 is used to control the flow of fluid from supply 108 and back flow preventer 112 precludes the contamination of supply 108 with slurry from line 92. Accordingly, after extended periods of operation or after a shutdown, valve 90 is closed and valve 110 is opened to allow fluid from supply 108 to be fed into inlet line 92. The fluid can then be transported through pump 94 and apparatus 10 to clean out any particles that have accumulated. In the case of lime slurries, the fluid used for fluid supply 108 is typically water.

Continuing with the exemplary embodiment of FIG. 5, during operation a slurry is received and/or stored in tank 70. If necessary, the concentration of slurry can be adjusted by the addition of a fluid, such as water, from supply line 114. Using agitator 76, the slurry is maintained by constant agitation. By opening valve 90, slurry is fed through outlet 86 in the lower portion of tank 74, through conduit 88, and on to pump 94 through line 92. Pump 94 then acts on slurry as it passes through path 102 to pump the slurry downstream to apparatus 10. As slurry flows through apparatus 10, the flexible member 14 contracts and expands to provide a pressure on the slurry as described above. Accordingly, when pump 94 is in suction mode or is turned off, apparatus 10 provides a back pressure against slurry discharging from the outlet 100 of pump 94 to ensure proper operation of the pump 94 and the metering of slurry therefrom. Therefore, back pressure is provided by apparatus 10 rather than by introducing a source of fluid under pressure at a point downstream from the outlet 100 of pump 94. In the case of lime slurries, the scaling or calcification that occurs by using water downstream of pump 94 to provide such back pressure is eliminated. In addition, because apparatus 10 operates to dampen the pulsations from positive displacement pump 94, settling and sedimentation of the slurry downstream of pump 94 is minimized. Because these problems are minimized or eliminated, the diameter of piping or tubing used for line 104 can be reduced to diameters previously believed to be ineffective due to problems with settling, scaling, calcification, clogging, or the like. In addition, the operation of apparatus 10 allows slurry to be pumped from pump 94 over greater distances than were previously obtainable due to such problems.

Where a gas is used with apparatus 10 to provide a pressure on the exterior surface 56 of flexible member 14, the pressure in chamber 54 can be tuned or adjusted so as to provide the desired amount of expansion and contraction of flexible member 14 and the desired amount of back pressure. By way of example, referring to FIG. 1 through FIG. 5, additional gas can be admitted to chamber 54 using valve 36 and gauge 38 if additional back pressure is needed. Alternatively, gas can be bled from chamber 54 using valve 36 if less back pressure is desired. The amount of back pressure needed can vary from application to application depending on factors such as the volume of slurry flow, the pressure of slurry flow, the rate of slurry flow, the size of piping used, the size of pump 94, and other factors that will be apparent to one of ordinary skill in the art using the teachings disclosed herein.

From the foregoing description of exemplary embodiments of the present invention, it will be apparent using the teachings disclosed herein that there are other embodiments of the invention and that modifications to the invention may be made without departing from the spirit and scope of the invention.

What is claimed is:

1. A slurry dispensing system, comprising:

a tank for receipt of the slurry, said tank having an outlet;

an agitator associated with said tank for providing agitation to the slurry;

a conduit in fluid communication with the outlet of said tank for delivering slurry from said tank;

a pump in fluid communication with said conduit;

a flexible member in fluid communication with said pump, said flexible member having an interior surface for contact with the slurry passing through and having an exterior surface;

a housing in which said flexible member is located, said housing and said flexible member forming a chamber for the receipt of a gas for applying a pressure upon the exterior surface of said flexible member; and said flexible member disposed between an inlet and an outlet of said housing with a generally uniform cross-sectional shape in a discharge mode of said pump, said flexible member collapsible on itself along at least a portion thereof during a suction mode of said pump to stop flow in a reverse direction and prevent siphoning backflow of the slurry through said flexible member.

2. A slurry dispensing system as in claim 1, wherein said pump is a positive-displacement pump.

3. A slurry dispensing system as in claim 1, wherein said conduit is inclined upwardly from the outlet of said tank.

4. A slurry dispensing system as in claim 3, wherein said conduit is inclined upwardly from said outlet at an angle of at least 30 degrees from horizontal.

5. A slurry dispensing system as in claim 1, wherein said flexible member is comprised of rubber.

6. An apparatus for slurry delivery, comprising:

a tank for receipt of the slurry, said tank having an upper portion and a lower portion, the lower portion having an outlet;

a conduit connected to the outlet of said tank, said conduit having a portion near the outlet of said tank that is inclined upwardly from the outlet of said tank;

a pump in fluid communication with said conduit; and an expandable member in fluid communication with said pump, said expandable member having an interior surface forming a non-restrictive channel for the flow through of the slurry in a discharge direction and having an exterior surface, said expandable member being configured so as to collapse generally completely along at least a portion thereof from said non-restrictive channel shape to block flow in a reverse direction and to provide an anti-siphon back pressure to said pump.

7. An apparatus for slurry delivery as in claim 6, further comprising a housing adapted for the receipt of said expandable member so as to form a chamber, whereby a gas may be held in the chamber so as to apply a pressure to the exterior surface if said expandable member.

8. An apparatus for slurry delivery as in claim 7, further comprising means for monitoring the pressure of the gas in the chamber.

9. An apparatus for slurry delivery as in claim 6, further comprising an agitator configured with said tank for providing agitation to the contents of said tank.

10. An apparatus for slurry delivery as in claim 9, wherein said agitator further comprises at least one propeller.

11. An apparatus for slurry delivery as in claim 6, wherein said conduit has a portion near the outlet of said tank that is inclined upwardly from the outlet at an angle of at least 30 degrees from the horizontal.

12. An apparatus for pumping slurry, comprising;

a tank for holding the slurry;

an agitator connected to said tank for providing agitation to the slurry;

a pump having an inlet and an outlet;

a flexible member in fluid communication with the outlet of the pump, said flexible member defining a channel therethrough in a discharge mode of said pump and blocking flow therethrough in a suction mode of said pump;

a housing containing said flexible member and adapted with said flexible member so as to form a chamber;

a gas supply line connected to said housing to provide gas to the chamber, a valve connected to said gas supply line, for allowing gas to be added or removed from the chamber; and said gas supplied to said chamber at a pressure sufficient to collapse said flexible member along at least a portion thereof so as to stop flow in a reverse direction and prevent siphoning of the slurry back through said flexible member during said suction mode of said pump.

13. An apparatus for pumping slurry as in claim 12, further comprising a pressure gauge pressure of gas in the chamber.

14. An apparatus for pumping slurry as in claim 12, wherein said flexible member is constructed of rubber.

15. An apparatus for pumping slurry as in claim 12, further comprising a conduit connecting said tank and said pump, said conduit having a portion that is inclined upwardly from the point of connection with said tank.

16. A process for delivering a slurry, comprising the steps or:

supplying the slurry to a pump, said pump having and inlet and an outlet;

discharging the slurry from said pump to a flexible element having an interior surface and an exterior surface:

feeding the slurry through said flexible element, whereby said flexible element expands or contracts so as to provide a back pressure against the slurry discharging from the outlet of said pump; and preventing siphoning of the slurry back through the pump by collapsing the flexible element along at least a portion thereof during periods of low or no discharge pressure of the pump to stop flow of the slurry through the flexible element in a reverse direction.

17. A process for delivering a slurry as in claim 16, further comprising the step of applying a pressure to the exterior surface of said flexible element using a gas.

18. A process for delivering a slurry as in claim 17, further comprising the step of adjusting the pressure of the gas so as to adjust the amount of expansion on contraction of said flexible element due to changes in the slurry being fed through said flexible element.

19. A process for delivery of a slurry as in claim 16, wherein said pump is positive-displacement type pump.

20. A process for delivery of a slurry as in claim 16, wherein said flexible element is comprised of rubber.

21. A process for delivering of a slurry as in claim 16, further comprising the step of delivering the slurry from said flexible element to further treatment, use, or storage.

22. A process for dispensing a slurry, comprising the steps of:

agitating the slurry in a tank, said tank being configured with an outlet;

delivering the slurry from the tank through a conduit connected to the outlet of said tank, said conduit being angled upwardly from said outlet;

pumping the slurry delivered from said conduit through an expandable member having an interior wall and an exterior wall, said expandable member being configured for applying a pressure to the slurry as it flows though said expandable member; and preventing siphoning of the slurry back through the pump by collapsing the flexible element onto itself during periods of low or no discharge pressure of the pump so as to stop flow through the expandable member in a reverse direction.

23. A process for dispensing a slurry as in claim 22, further comprising the step of applying a pressure to the exterior wall of said expandable member using a gas.

24. A process for dispensing a slurry as in claim 22, further comprising the step of adjusting the pressure of the gas until the desired amount of pressure is applied to the slurry flowing through said expandable member.

25. A process for dispensing a slurry as in claim 22, wherein said pump is a positive-displacement type pump.

* * * * *